US009969520B2

(12) United States Patent
Gill et al.

(10) Patent No.: US 9,969,520 B2
(45) Date of Patent: May 15, 2018

(54) VACUUM RESISTANT RIBS FOR LIGHTWEIGHT BASE TECHNOLOGY CONTAINERS

(75) Inventors: Matthew T. Gill, Hellam, PA (US); Raymond A. Pritchett, Jr., Brogue, PA (US); Travis A. Hunter, Hellam, PA (US)

(73) Assignee: GRAHAM PACKAGING COMPANY, L.P., Lancaster, PA (US)

( * ) Notice: Subject to any disclaimer, the term of this patent is extended or adjusted under 35 U.S.C. 154(b) by 1451 days.

(21) Appl. No.: 12/889,601

(22) Filed: Sep. 24, 2010

(65) Prior Publication Data

US 2012/0074151 A1 Mar. 29, 2012

(51) Int. Cl.
*B65D 8/08* (2006.01)
*B65D 1/02* (2006.01)

(52) U.S. Cl.
CPC ..... *B65D 1/02* (2013.01); *B65D 1/0223* (2013.01); *B65D 2501/0036* (2013.01)

(58) Field of Classification Search
CPC ..... B65D 1/0492; B65D 1/0457; B65D 1/04; B65D 1/165; B65D 1/265; B65D 1/0223
USPC ..... 215/383
See application file for complete search history.

(56) References Cited

U.S. PATENT DOCUMENTS

| | | | | |
|---|---|---|---|---|
| 5,011,648 | A | 4/1991 | Garver et al. | |
| 5,067,622 | A | 11/1991 | Graver et al. | |
| 5,337,909 | A | 8/1994 | Vailliencourt | |
| 5,713,480 | A | 2/1998 | Petre et al. | |
| 6,065,624 | A | 5/2000 | Steinke | |
| 6,585,125 | B1 | 7/2003 | Peek | |
| 6,612,451 | B2 | 9/2003 | Tobias et al. | |
| 6,662,960 | B2 | 12/2003 | Hong et al. | |
| 7,021,479 | B2 * | 4/2006 | Pedmo et al. | 215/381 |
| 7,178,684 | B1 | 2/2007 | Budden et al. | |
| 7,347,339 | B2 | 3/2008 | Bangi et al. | |
| 2004/0195199 | A1 | 10/2004 | Maki et al. | |
| 2007/0045221 | A1 | 3/2007 | Trude et al. | |
| 2007/0084821 | A1 * | 4/2007 | Bysick et al. | 215/373 |
| 2008/0047964 | A1 | 2/2008 | Denner et al. | |
| 2008/0083696 | A1 * | 4/2008 | Nievierowski et al. | 215/384 |
| 2009/0321384 | A1 | 12/2009 | Zhang et al. | |
| 2010/0032405 | A1 | 2/2010 | Ozawa et al. | |
| 2010/0155359 | A1 | 6/2010 | Simon et al. | |

FOREIGN PATENT DOCUMENTS

| | | | |
|---|---|---|---|
| EP | 1179482 | A1 | 2/2002 |

OTHER PUBLICATIONS

International Search Report dated Oct. 20, 2011. EPO is the International Searching Authority.

* cited by examiner

*Primary Examiner* — Andrew T Kirsch
*Assistant Examiner* — Kevin Castillo
(74) *Attorney, Agent, or Firm* — Baker Botts L.L.P.

(57) ABSTRACT

A hot-fillable container that is cylindrical in shape. The container may have two ribs. A top rib is located in the top bumper and a bottom rib is located in the bottom bumper. Both the top and the bottom ribs have depth that is deep enough so that the container may withstand the hot-fill process and increase its top load ability.

21 Claims, 8 Drawing Sheets

VACUUM RESISTANT RIBS FOR LIGHTWEIGHT BASE TECHNOLOGY CONTAINERS

BACKGROUND OF THE INVENTION

1. Field of the Invention

The field of the invention is directed to hot-fill containers. In particular the field of the invention is directed to ribbed containers.

2. Description of the Related Technology

Plastic containers are used due to their durability and lightweight nature. Polyethylene terephthalate (PET) is used to construct many of today's containers. PET containers are lightweight, inexpensive, recyclable and manufacturable in large quantities.

PET containers are used for products, such as beverages. Often these liquid products, such as juices and isotonics, are placed into the containers while the liquid product is at an elevated temperature, typically between 68° C.-96° C. (155° F.-205° F.) and usually about 85° C. (185° F.). When packaged in this manner, the hot temperature of the liquid is used to sterilize the container at the time of filling. This process is known as hot-filling. The containers that are designed to withstand the process are known as hot-fill containers.

The use of blow molded plastic containers for packaging hot-fill beverages is well known. However, a container that is used in the hot-fill process is subject to additional stresses on the container that can result in the container failing during storage or handling or to be deformed in some manner. The sidewalls of the container can become deformed and/or collapse as the container is being filled with hot fluids. The rigidity of the container can decrease after the hot-fill liquid is introduced into the container. The top-load of a container may also be affected.

After being hot-filled, the hot-filled containers are capped and allowed to reside at about the filling temperature for a predetermined amount of time. The containers and stored liquid may then be cooled so that the containers may be transferred to labeling, packaging and shipping operations. As the liquid stored in the container cools, thermal contraction occurs resulting in a reduction of volume. This results in the volume of liquid stored in the container being reduced. The reduction of liquid within the sealed container results in the creation of a negative pressure or vacuum within the container. If not controlled or otherwise accommodated for, these negative pressures result in deformation of the container which leads to either an aesthetically unacceptable container or one which is unstable. The container must be able to withstand such changes in pressure without failure.

The negative pressure within the container has typically been compensated for by the incorporation of flex panels in the sidewall of the container. Hot-fill containers may typically include substantially rectangular vacuum panels that are designed to collapse inwardly after the container has been filled with hot product. These flex panels are designed so that as the liquid cools, the flex panels will deform and move inwardly. Wall thickness variations, or geometric structures, and the like, can be utilized to prevent unwanted distortion. Generally, the typical hot-fillable container structure is provided with certain pre-defined areas which flex to accommodate volumetric changes and certain other pre-defined areas which remain unchanged.

While the usage of flex panels may be successful, the employment of these flex panels inhibit the usage of different geometries in the formation of the container. Usage of multiple ribs may also be detrimental to the aesthetic appeal of the container. Therefore, there is a need in the field for a container that is able to withstand the hot fill process without utilizing flex panels or multiple ribs, so as to decrease the weight of the container and improve the aesthetic appeal of the container.

SUMMARY OF THE INVENTION

An object of the present invention is hot-fillable container.

Another object of the present invention is a hot-fillable container with ribs located within bumper portions.

Still yet another object of the present invention is an aesthetically pleasing container having few body ribs.

An aspect of the present invention may be a container comprising: a finish connected to a neck; a top portion located below the neck; a top bumper portion located below the top portion; a top rib located within the top bumper portion; a body portion located below the top bumper; and a bottom bumper located below the body portion and above a base portion of the container, wherein the bottom bumper comprises a bottom rib; and wherein the body portion comprises two or less body ribs.

Another aspect of the present invention may be a hot-fillable container comprising: a top portion having a first radius with respect to a longitudinal axis greater than any radius on a body portion; the body portion located below the top portion, wherein the body portion comprises a body rib; a base portion having a second radius with respect to the longitudinal axis greater than any radius on the body portion; and wherein the top portion comprises a top rib and the base portion comprises a bottom rib, wherein the top rib and the bottom rib have a greater depth than the body rib.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE PREFERRED EMBODIMENT(S)

The container 10 may have a one-piece construction and may be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which may also include additives to vary the physical or chemical properties of the material. For example, some plastic resins may be modified to improve the oxygen permeability. Alternatively, the container may be prepared from a multilayer plastic material. The layers may be any plastic material, including virgin, recycled and reground material, and may include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container is prepared from PET.

The container 10 is constructed to withstand the rigors of hot-fill processing. Container 10 may be made by conventional blow molding processes including, for example, extrusion blow molding, stretch blow molding and injection blow molding. Plastic blow-molded containers, particularly those molded of PET, have been utilized in hot-fill applications where the container is filled with a liquid product heated to a temperature in excess of 180° F. (i.e., 82° C.), capped immediately after filling, and then allowed to cool to ambient temperatures.

Figure 1:
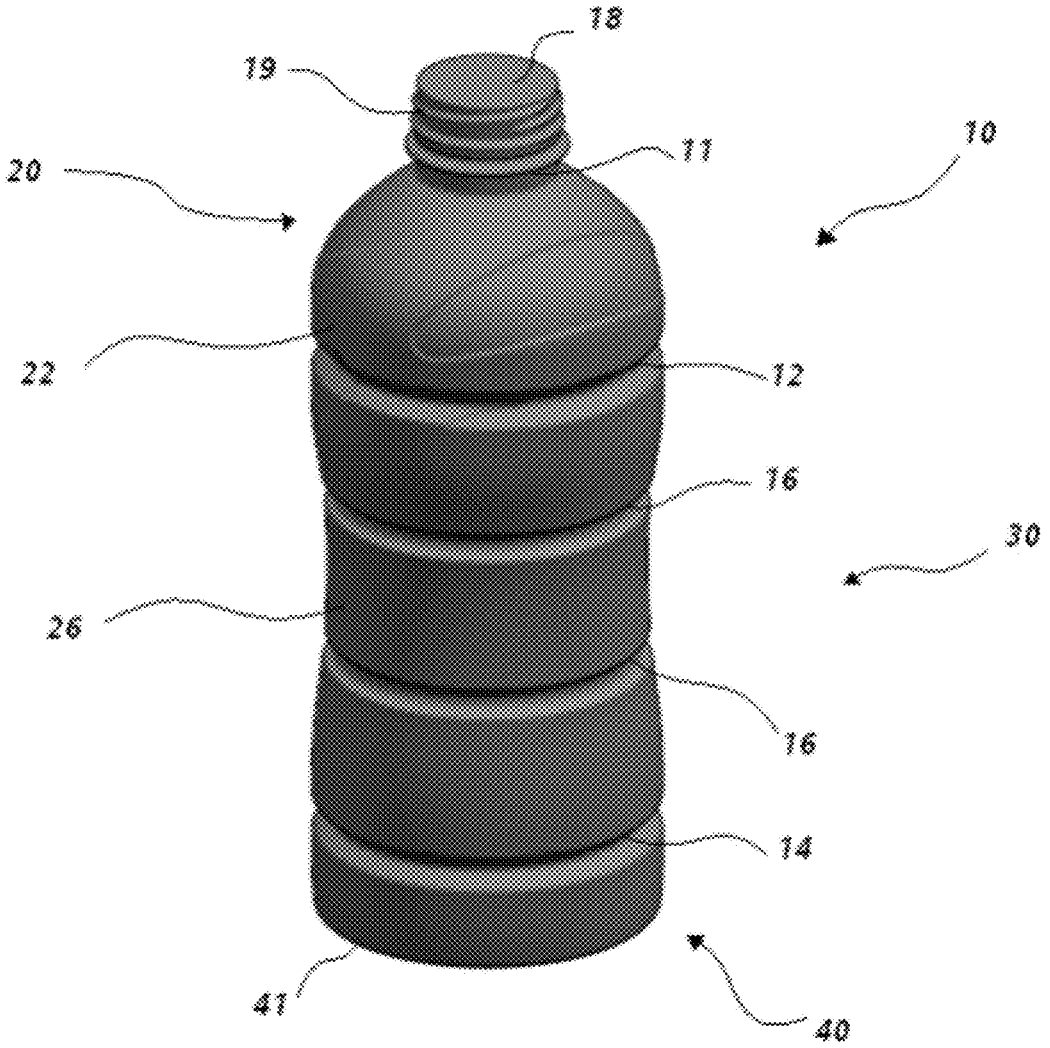
FIG. 1 shows a perspective view of a container made in accordance with an embodiment of the present invention.
Figure 2:
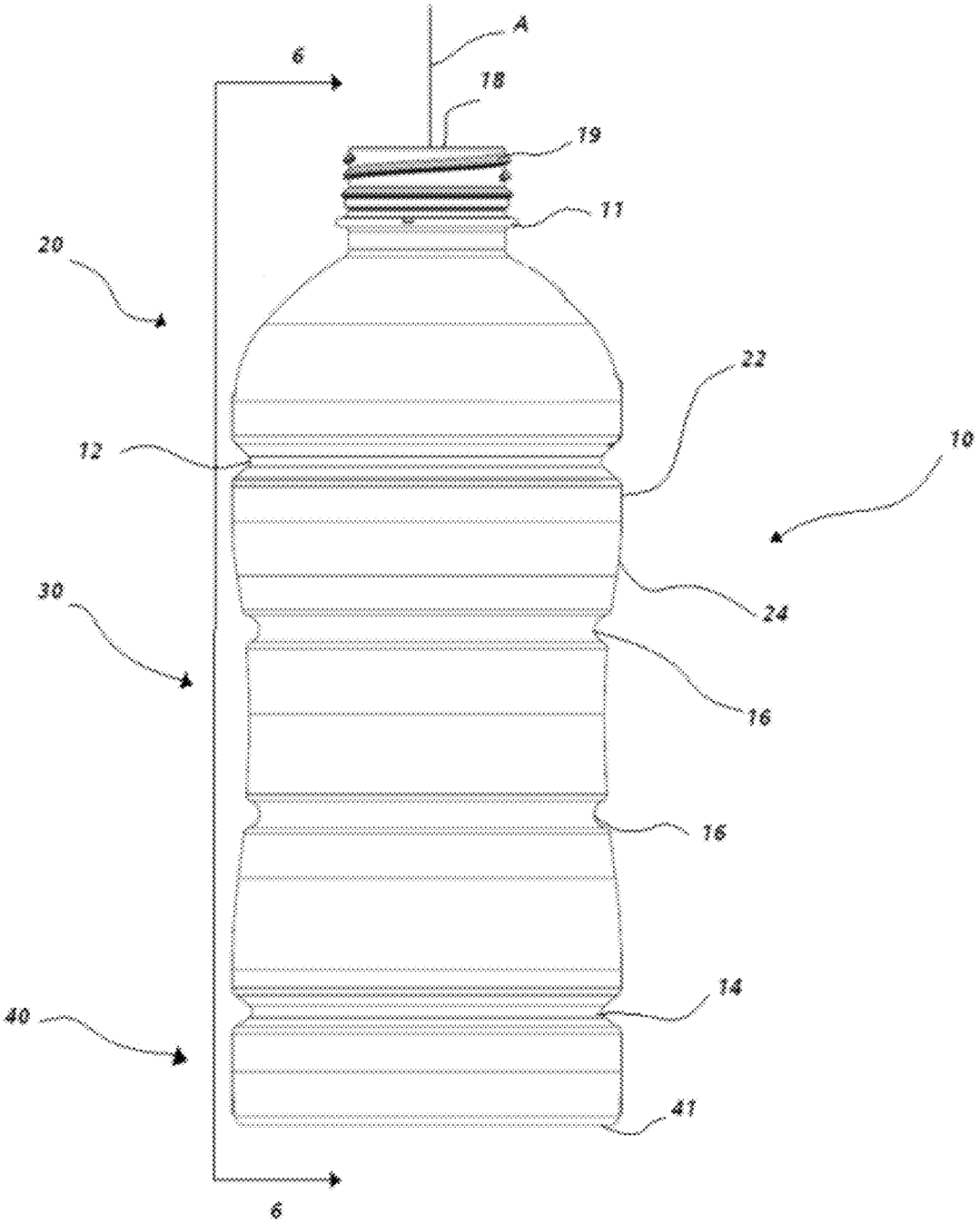
FIG. 2 shows a front view of a container made in accordance with an embodiment of the present invention.

FIG. 1 shows a perspective view of a container 10 made in accordance with an embodiment of the present invention. FIG. 2 shows a front view of the container 10. The container 10 shows a top portion 20, a body portion 30 and a base portion 40. The container 10 shown in FIG. 1 has a generally cylindrical shape with an hourglass portion. In particular, the body portion 30 slopes inwardly towards the longitudinal axis A of the container A and provides an hourglass shape to the container 10. The body portion 30 is located between the top portion 20 and the base portion 40.

The top portion 20 has an opening 18 with a threaded finish 19. Located below the threaded finish 19 is a neck 11. The top portion 20 is generally dome shaped and slopes downwardly to the top bumper 22. The top bumper 22 comprises a top rib 12 located proximate to the body portion 30. The top bumper 22 is a portion of the container 10 which has the largest radius with respect to the longitudinal axis A and is that portion of the container 10 with the largest diameter, along with the bottom bumper 46.

The body portion 30 has a body surface 26, which slopes inwardly from the bottom of the top rib 12 and top bumper 22 towards the longitudinal axis A of the container 10. In the embodiment shown in FIGS. 1 and 2 there are two body ribs 16 shown. Between the body ribs 16, the body surface 26 forms a slight arc. Below the lower body rib 16, the body surface 26 slopes outwardly, away from the longitudinal axis A of the container 10. It should be understood that fewer or more body ribs 16 may be present in the body portion 16 and the invention is not limited to two. However it should be noted that it is preferable that at least one body rib 16 be present so as to provide some additional support to the body 10.

The top rib 12 and the bottom rib 14 are located above and below the body portion 30 respectively. The top rib 12 merges with and is part of the top bumper 22. The bottom rib 14 merges with and is part of the base bumper 46. The top rib 12 and bottom rib 14 extend further into the cavity formed by the body portion 30 than any of the body ribs 16. In other words the top rib 12 and the bottom rib 16 have a greater depth with respect to the surface of the container 10. Since the top rib 12 and the bottom rib 14 are located on the container 10 where the greatest diameter exists, they do the most in keeping the bottle substantially round under vacuum conditions. The body ribs 16 have minimal effect on vacuum performance and do not have as great a depth as the top rib 12 and the bottom rib 14. The usage of the top rib 12 and the bottom rib 14 enable the container 10 to withstand the vacuum pressure from the hot-fill process. The container 10 is able to be a lightweight due to the usage of fewer body ribs 16. The top rib 12 and the bottom rib 14 further enable the container 10 to withstand a high top load.

However, too many of the deeper ribs, such as top rib 12 and bottom rib 14, would decrease the top load of the container 10 substantially and the container 10 would need to be heavier weight to compensate. Additionally, the blow molding process may be simplified due to the reduced geometry of the container 10.

Figure 3:
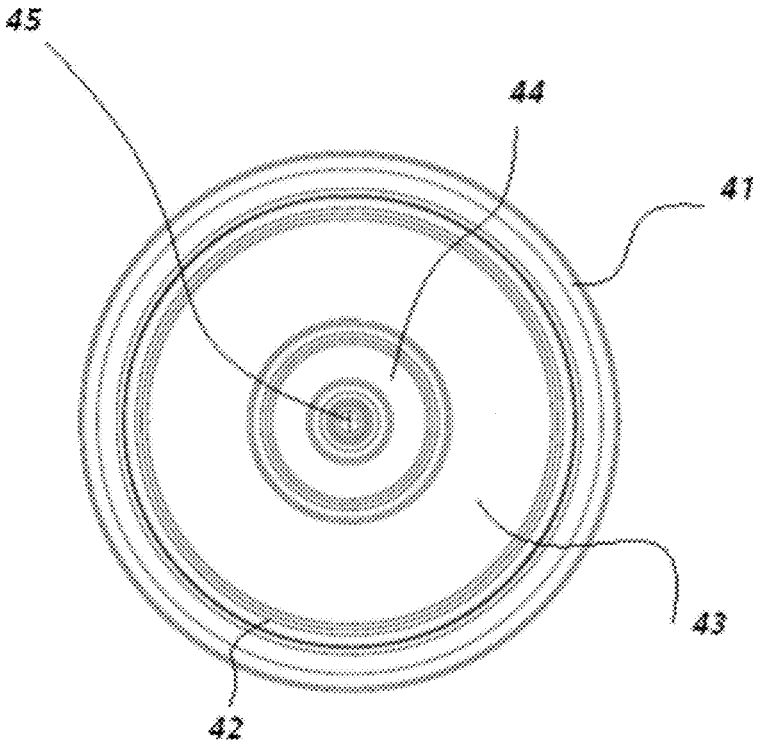
FIG. 3 is a bottom view of the container shown in FIG. 2.
Figure 4:
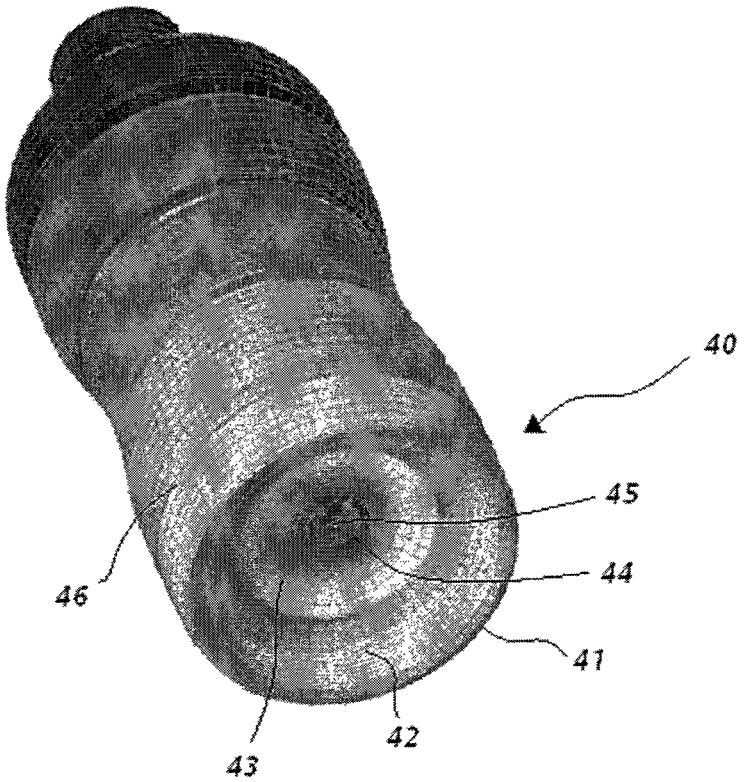
FIG. 4 is a view of the container showing the distribution of heat in the container.

FIGS. 3 and 4 show the base portion 40, which comprises the bottom bumper 46, which merges with the body portion 30 of the container 10. The bottom bumper 46 is a portion of the container 10 which has the largest radius with respect to the longitudinal axis A and is a portion of the container 10 with the largest diameter along with the top bumper 22. The base portion 40 has a lower rim 41. FIG. 3 shows the base portion 40. The base portion 40 is a slingshot base and that slopes upwardly into the cavity of the container 10. The base portion 40 has a first region 42, a second region 43 and a third region 44, which all take up vacuum at different rates. The regions increase in thickness and culminates in the apex 45.

FIG. 4 is a view of the container 10 showing the distribution of vacuum uptake by the container 10. As shown in FIG. 4 the regions of the base portion 40 uptake a significant amount of the vacuum. The base portion 40 cooperates with the top rib 12 and the bottom rib 14 to enable hot-fill capacity and to increase the top load capability of the container 10.

Figure 5:
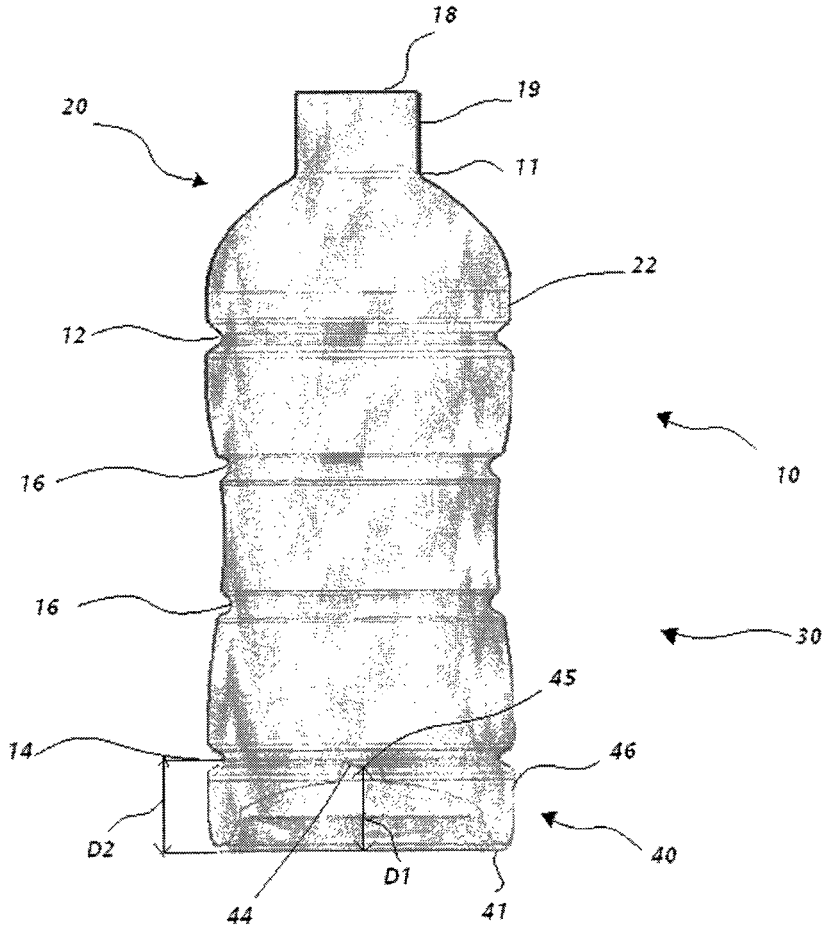
FIG. 5 shows a container illustrating the base structure within the container.

FIG. 5 shows a container illustrating the base portion 40 within the container 10 both before and after vacuum uptake. The apex 45 of the base portion 45 extends a distance D1 into the container 10, which may be between 0.75 and 1.25 inches, preferably between 0.85 and 1.15 inches and in the embodiment shown in FIG. 5 is approximately 1 inch. The center of the base portion 45 lies along the longitudinal axis A of the container 10, which runs through the center. The distance D2 from the center of the bottom rib 14 to the lower rim 41 of the base is equal to the distance D1 that the apex 45 extends into the cavity. This increases the strength of the container 10 and the overall hot-fill capacity of the container 10.

Figure 6:
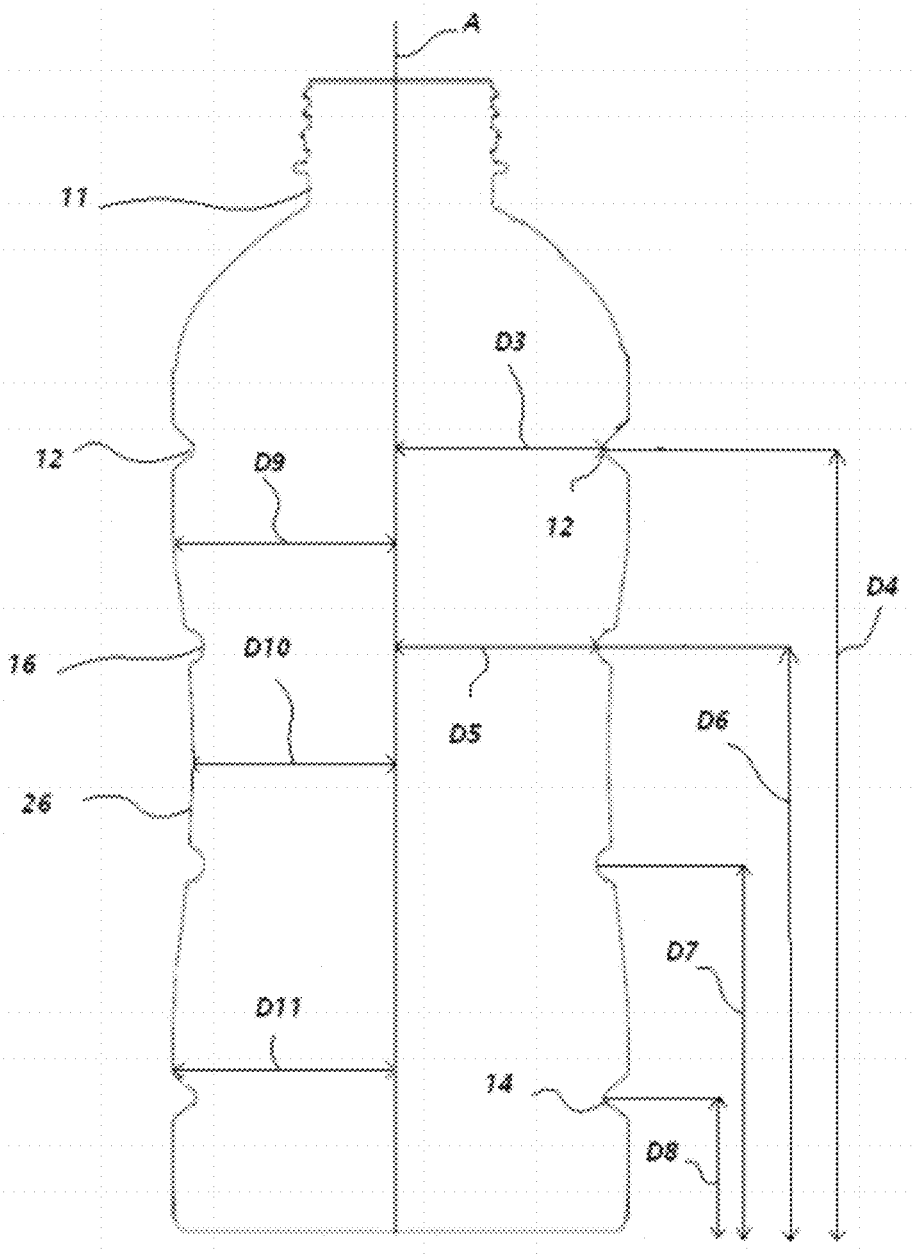
FIG. 6 shows a cross-sectional view of the container shown in FIG. 2.

FIG. 6 shows a cross-sectional view of the container shown in FIG. 2. In FIG. 6, the distance from the longitudinal axis A to the top rib 12 is D3, D3 may be between 1.3 to 1.7 inches, is preferably between 1.4 to 1.6 inches and in the embodiment shown in FIG. 6 is approximately 1.570 inches; this distance is also the same for the bottom rib 14. The distance from the body rib 16 to the longitudinal axis A may be between 1.3 to 1.7 inches, is preferably between 1.4 to 1.6 inches and in the embodiment shown in FIG. 6 is approximately D5=1.522 inches. The distance D3 is greater than the distance D5 due to the radius of the top portion 20 at the top bumper 22. The distances D3 and D5 also reflect the radii of the container 10 due to its circular shape.

The distance from the bottom of the base 40 to the top rib 12 is D4 and in the embodiment shown may be between 5 to 6 inches, is preferably between 5.25 to 5.75 inches and in the embodiment shown in FIG. 6 is approximately 5.45 inches. The distance from the base 40 to the body rib 16 is D6. In the embodiment shown D6 may be between 3.5 to 4.5 inches, is preferably between 3.75 to 4.25 inches and in FIG. 6 is approximately 4 inches. The distance D4 is greater than the distance D6.

The distance from the bottom of the base 40 to the second body rib 16 is D7 and in the embodiment shown may be between 2 to 3 inches, is preferably between 2.25 to 2.75 inches and in the embodiment shown in FIG. 6 is approximately 2.6 inches. The distance from the base 40 to the bottom rib 14 is D8. In the embodiment shown, D8 may be between 0.5 to 1.5 inches, is preferably between 0.75 to 1.25 inches and in the embodiment shown in FIG. 6 is approximately 1 inches. The distance D7 is greater than the distance D8.

The distance of the surface of the top bumper 22 located between the top rib 12 and the first body rib 16 to the longitudinal axis A is D9. The distance of the surface of the bottom bumper 46 to the longitudinal axis A is D11. The distance of the surface 26 of the body 30 located between the first and second body ribs 16 to the longitudinal axis A is D10. The distances D9 and D11 are equal and are both greater than the distance D10. This is reflected in the hourglass shape of the container 10.

Figure 7:
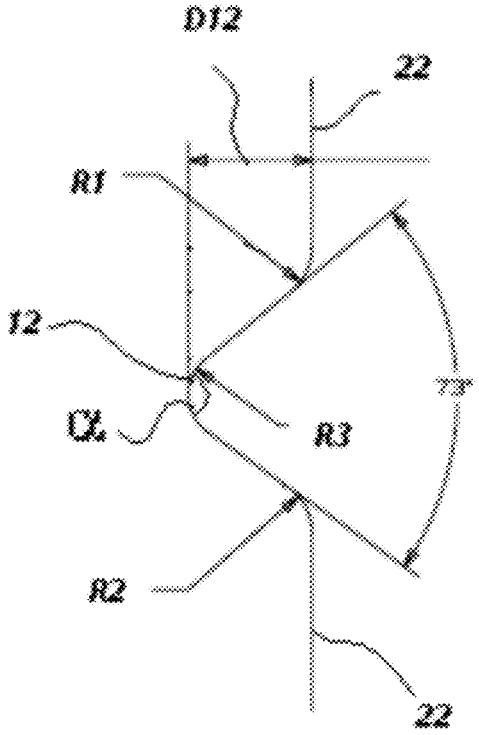
FIG. 7 shows a top rib from the container in accordance with an embodiment of the present invention.

FIG. 7 shows a top rib 12 from the container 10 and the depth D12 of the top rib 12. The depth D12 of the top rib 12 is the distance from the surface of the top bumper 22 to the bottom of the top rib 12. D12 may be between 0.1 to 0.2 inches, is preferably between 0.13 to 0.18 inches and in FIG. 7, D12 is approximately 0.175 inches. It should be understood that the ranges and description provided for the top rib 12 are equivalent to that for the bottom rib 14.

Also shown in FIG. 7, is the angle $\alpha$ formed by the top rib 12 that differs from the semi-circular nature of the body ribs 16. The angle $\alpha$ may be between the range 60-80°, is preferably between 65-75° and/or less than 75° and in FIG. 7 $\alpha$ is 73°. The body rib 16 is semi-circular. The radii of curvatures of the top rib 12 are R1, R2 and R3, which have the values of 0.08, 0.08 and 0.065 inches respectively.

Figure 8:
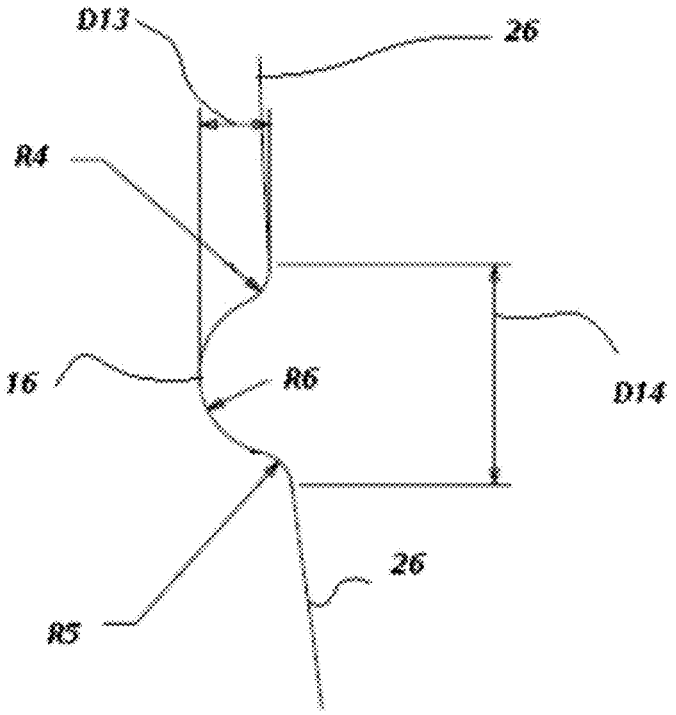
FIG. 8 shows a middle rib from the container made in accordance with an embodiment of the present invention.

FIG. 8 shows a body rib 16 from the container 10 and a depth D13 of the body rib 16. The depth D13 of the body rib 16 is the distance from the body surface 26 to the bottom of the body rib 16. The depth D13 may be between 0.05 to 0.12 inches, is preferably between 0.09 to 0.11 inches and in FIG. 8, D13 is approximately 0.109 inches. The depth D12 is greater than the depth D13. The depth D13 may be less than 65% of the depth of D12.

FIG. 8 also shows the distance D14 between the top of the body rib 16 to the bottom of the body rib 16. The distance D14 is approximately 0.347 inches.

The radii of curvatures of the body rib 16 are R4, R5 and R6. R4, R5 and R6 have the values of 0.06, 0.06 and 0.125 inches respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A container comprising:

a finish connected to a neck;

a top portion located below the neck;

a top bumper portion located below the top portion;

a top rib located within and extending about an entire outer circumferential perimeter of the top bumper portion and having a depth with respect to the circumferential perimeter of the top bumper portion;

a body portion located below the top bumper;

a bottom bumper located below the body portion and above a base portion of the container, wherein the bottom bumper comprises a bottom rib extending about an entire outer circumferential perimeter of the bottom bumper and having a depth with respect to the circumferential perimeter of the bottom bumper; and wherein the body portion comprises at least one body rib extending about an entire outer circumferential perimeter of the body portion, each body rib having a depth with respect to the circumferential perimeter of the body portion, the top rib and the bottom rib each having a greater depth than each body rib.

2. The container of claim 1, comprising one body rib.

3. The container of claim 1, wherein each body rib is less than 65% the depth of the top rib.

4. The container of claim 1, wherein the top rib and the bottom rib each has a greater depth than each body rib.

5. The container of claim 1, wherein a cross-section of the body portion is generally circular.

6. The container of claim 1, wherein the body portion is generally hourglass shaped.

7. The container of claim 1, wherein the top rib and bottom rib have substantially equal depths.

8. The container of claim 1, wherein the top rib and the bottom rib are located equidistantly from a longitudinal axis A of the container.

9. The container of claim 1, wherein an angle formed by the top rib is less than 75°.

10. The container of claim 1, wherein the container is hot-filled.

11. The container of claim 1, wherein the container includes two body ribs.

12. A hot-fillable container comprising:

a top portion having a first radius with respect to a longitudinal axis greater than any radius on a body portion;

the body portion located below the top portion, wherein the body portion comprises at least one body rib extending about an entire outer circumferential perimeter of the body portion;

a base portion having a second radius with respect to the longitudinal axis greater than any radius on the body portion; and wherein the top portion comprises a top rib and the base portion comprises a bottom rib, wherein the top rib and the bottom rib each has a greater depth with respect to an outer circumferential perimeter proximate thereto than each body rib.

13. The container of claim 12 wherein a cross-section of the body portion is generally circular.

14. The container of claim 12, wherein the body portion is generally hourglass shaped.

15. The container of claim 12, wherein an angle formed by the top rib is less than 75°.

16. The container of claim 12, wherein the top rib and bottom rib each has substantially equal depths.

17. The container of claim 12, wherein the top rib and the bottom rib are located equidistantly from a longitudinal axis A of the container.

18. The container of claim 12, comprising one body rib.

19. The container of claim 12, wherein the container includes two body ribs.

20. The container of claim 12, wherein the base portion comprises a bottom surface extending into a cavity of the container.

21. The container of claim 20, wherein the bottom surface extends from a bottom rim into the cavity of the container a distance D1, and the distance D1 is equal to a distance D2 from the bottom rim to the bottom rib.

* * * * *